United States Patent [19]

Rubinstein et al.

[11] 4,365,491

[45] Dec. 28, 1982

[54] GUARD PLATE

[76] Inventors: Edward Rubinstein, 3325 Neptune Ave., Brooklyn, N.Y. 11224; Efim Rubinshtein, 2612 West St., Brooklyn, N.Y. 11223

[21] Appl. No.: 147,623

[22] Filed: May 7, 1980

[51] Int. Cl.[3] ..... E05B 17/14; E05B 37/12

[52] U.S. Cl. ..... 70/425; 70/288; 70/292

[58] Field of Search ..... 70/425, 426, 423, 424, 70/427, 428, 287, 288, 329, 304, 312, 292, 293, 294

[56] References Cited

U.S. PATENT DOCUMENTS 41,211 1/1864 Felter ..... 70/425
3,723,682 3/1973 Pecott ..... 70/425
4,114,408 9/1978 Gee ..... 70/288

FOREIGN PATENT DOCUMENTS 752 7/1984 Italy ..... 70/425

*Primary Examiner*—Robert L. Wolfe
*Attorney, Agent, or Firm*—Lilling & Greenspan

[57] ABSTRACT

The improved guard plate of this invention is used to protect the cylinder of a lock. It includes a relatively flat body, attached to the door in the vicinity of the cylinder, and a disc rotatably mounted between the door and the flat body. In an open position, an opening in the disc permits access to the cylinder; and, in the closed position, the solid portions of the disc do not permit access to the cylinder. In addition, rotatable fingers are provided so as to lock the rotatable discs in either the open or closed position.

14 Claims, 10 Drawing Figures

GUARD PLATE

BACKGROUND OF THE INVENTION

The guard plates presently used for protecting lock cylinders are generally disposed over the cylinder on the outside surface of the door. Such plates prevent intruders from penetrating the cylinder and thus opening the door.

One disadvantage of these guard plates is that the keyhole portion of the cylinder is still accessible to unwanted intruders. Thus, it is an object of this invention to provide a guard plate which will also cover the keyhole portion of the cylinder. In this way, the lock and its cylinder will be protected even more from tampering and from picking. Furthermore, the improved guard plate of this invention prevents glue or other foreign materials from getting into the keyhole or the cylinder itself.

DETAILED DESCRIPTION OF THE INVENTION

Figure 1:
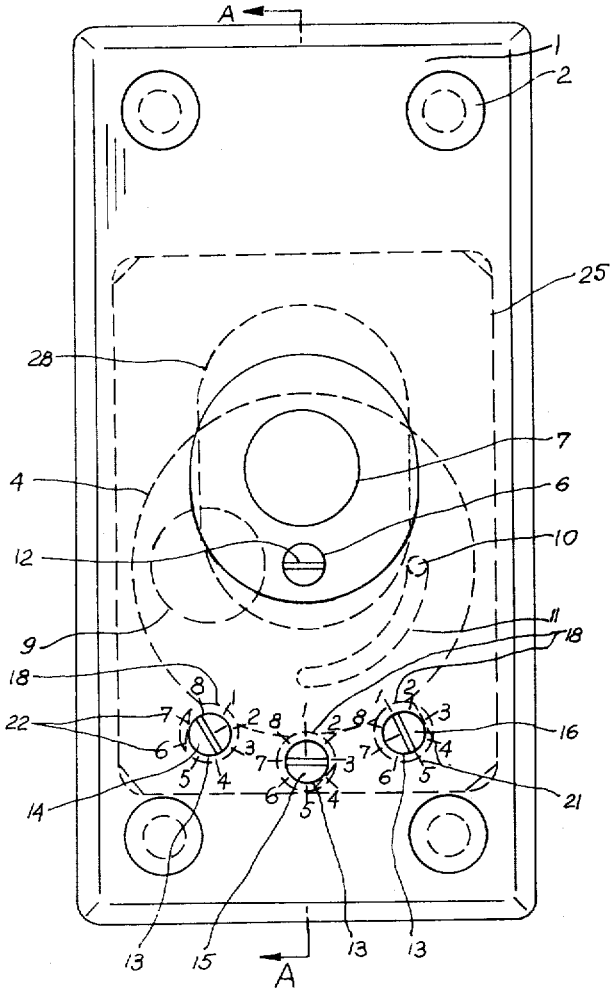
FIG. 1 is a front view of the improved guard plate in the closed position.
Figure 2:
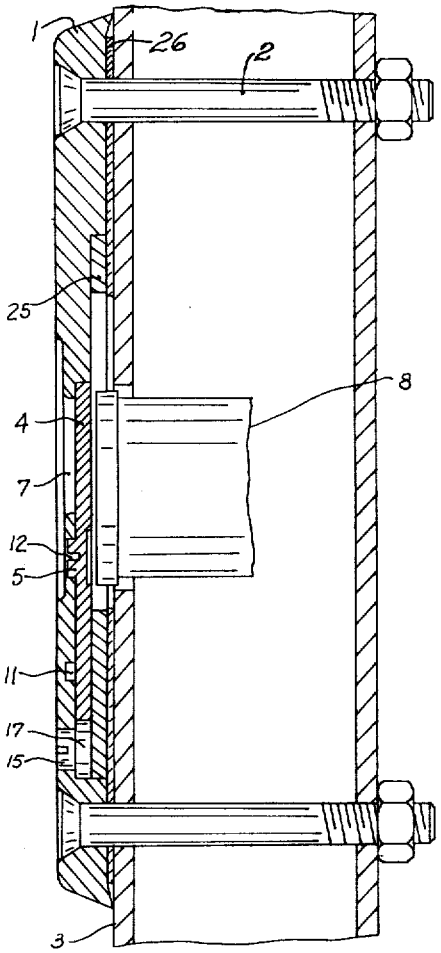
FIG. 2 is a cross-sectional view of the improved guard plate taken substantially along the lines A—A of FIG. 1.
Figure 6:
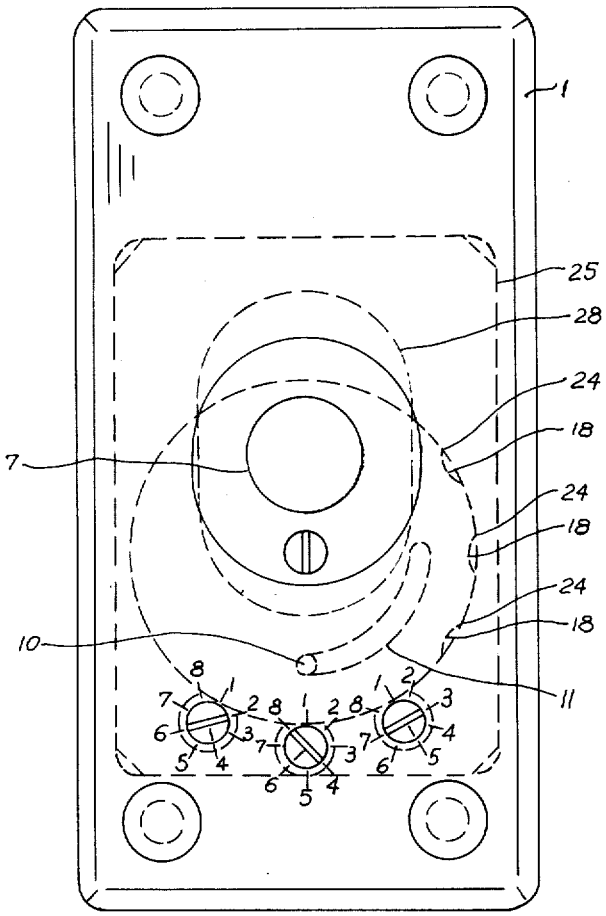
FIG. 6 is a front view of the guard plate in the open position.

As is best shown in FIGS. 1, 2 and 6, the improved guard plate includes a relatively flat body or plate 1, which is generally attached in a conventional manner to the outside surface of a door 3, such as by means of bolts 2. The body may be made from any strong material, but it is preferably made of metal. Further, a hole 7 is defined in the body 1 in order to provide access to the keyhole of the cylinder 8 of the lock.

Positioned between the flat body 1 and the outer surface of the door 3 is a rotatably mounted disc 4. In the approximate center of the disc 4 a short stem or nub 5 is provided. This stem 5 of the disc 4 may then be positioned within a second hole or opening 6 within the body 1. Thus, the hole or opening 6 acts as a sort of bushing and permits rotation of the disc 4. Further any other conventionally known methods of rotatably mounting the disc 4 may be provided. In the preferred embodiment, a slot 12 is provided on the front surface of the stem 5 (see FIG. 2). Then, a flat object, such as a special key-plate, can be inserted into the slot 12 in order to rotate the disc 4. In some embodiments, the stem 5, and the slot 12, may be recessed partially within the hole 6 of the body 1, or, in other embodiments, the stem 5 may extend completely through the hole 6 and extend outward from the body 1. In still other embodiments, it is possible to eliminate the slot 12 and merely extend the stem 5 through the hole 6 and to permit it to extend outward from the body 1. This way the stem can act as a sort of handle and may be easily rotated by the user's fingers.

On the inner surface of the body 1 a circular groove or slot 11 is preferably positioned. A stop 10 is positioned on the outer surface of the disc 4 so that it may move within the circular slot 11 as the disc is rotated. In other embodiments, it is possible to provide the stop on the body 1 and the groove or slot 11 on the disc 4. In addition, a hole or opening 9, approximately equal in size to the hole or opening 7 in the body 1, is made in the disc 4. In the open position of the guard plate (see FIG. 6), the disc 4 is set so that its opening or hole 9 is aligned with the hole 7 in the body and access is provided to the keyhole of the cylinder 8 of the lock. As can be seen, the stop 10 is at one extreme end of the circular slot 11 and further clockwise rotation of the disc 4 is not possible. In order to prevent access to the keyhole of the cylinder, the disc 4 is rotated in a counterclockwise direction. This causes the hole or opening 9 of the disc to move away from the hole or opening 7 in the body 1. Thus, the solid portions of the disc effectively close the hole or opening 7 in the plate and prevent access to the keyhole of the cylinder. During this rotation of the disc, the stop 10 moves in the circular slot 11 until it reaches the other extreme end of the slot (see FIG. 1). At this point, further rotation of the disc 4 is not possible and the hole 7 is completely covered by the solid portions of the disc 4 (see FIG. 1).

In order to prevent rotation of the disc 4 by intruders, a plurality of locking fingers 14, 15 and 16 are provided. The exact number of fingers provided is dependent on the degree of security desired. If more fingers are provided, then the guard plate will be more secure. Obviously, if less fingers are provided, the guard plate will be less secure. In the preferred embodiments, three fingers are provided, but it should be understood that any number of fingers may be used.

Through holes 13 are provided in the body 1 near the periphery of the disc 4. Then, the fingers 14, 15 and 16 are rotatably inserted into respective holes. Considering now the second finger 15 (see FIGS. 2 and 4), its construction will be considered, but it should be pointed out that the construction of all of the fingers is the same. The finger 15 is essentially round in shape with a circular flange 17 provided at its back end. Preferably the diameter of the flange 17 is greater than the respective through hole 13. This prevents the finger from being easily removed from the improved guard plate. The rounded portions of the flanges interact with respective circular grooves 18 located on the periphery of the disc 4. This effectively prevents rotation of the disc 4. The flange portion 17 of each of the fingers is further provided with cutoff portions 23. When the fingers are rotated so that the cutoff portions 23 are aligned with the respective grooves 18, the fingers no longer serve to prevent rotation of the disc 4.

Figure 3:
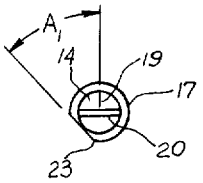
FIG. 3 is a front view of a first finger.
Figure 4:
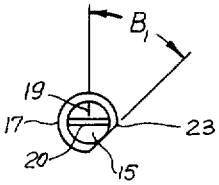
FIG. 4 is a front view of a second finger.
Figure 5:
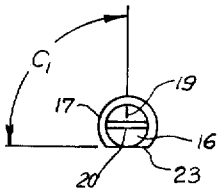
FIG. 5 is a front view of a third finger.
Figure 7:
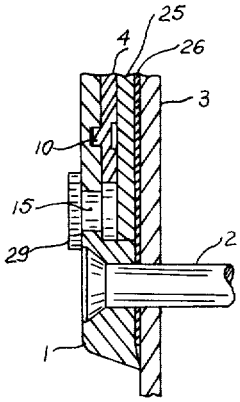
FIG. 7 is a view similar to FIG. 2, but showing another embodiment of the fingers.
Figure 10:
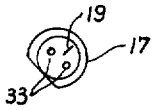
FIG. 10 is a front view of another embodiment of the fingers.

As best shown in FIGS. 3, 4 and 5, each of the fingers 14, 15 and 16 is provided with a slot 20 on its front face. A flat object, such as the special key-plate used to rotate the disc 4, may then be fitted into the slots 20 of the fingers and used to rotate the fingers. If desired, the front face of the fingers may be recessed within the respective through holes 13. In other embodiments, it is possible for the fingers to extend through the holes 13 and extend outward from the body 1. In such a case, it may be desirable to provide an enlarged head 29 on the front face of the finger, in order to facilitate rotation of the fingers (see FIG. 7). Alternatively, in another embodiment of the fingers, small holes 33 may be provided on the front face of the fingers (FIG. 10). Then, the special key may be inserted into the holes to rotate the fingers. Furthermore, any other known method of rotating the fingers may be used.

It is preferable that alignment marks 19 be provided on the front faces of the fingers. In addition, additional alignment marks 21 should be placed on the surface of the body 1 near the fingers. Thus, when the fingers are rotated, the user knows that the cutoff portions 23 of the flange 17 will be aligned with the grooves 18 when the alignment mark 19 is aligned with a certain alignment mark 21. To facilitate this process of identifying the correct alignment mark 21, numbers 22 may be provided near the alignment marks 21. Then, the user of the improved guard plate may need only remember a simple combination for the fingers. In the embodiments shown in this application (see FIG. 6), the combination is 4 6 5. As can be seen from FIGS. 3–5, the cutoff portions 23 of the flanges 17 of the fingers may be made at different angles to the alignment mark 19 of that finger. For example, the cutoff portion 23 of the finger 14 is at an angle A1 to the alignment mark 19, the cutoff portion 23 of the finger 15 is at an angle B1 to the alignment mark 19, and the cutoff portion 23 of the finger 16 is at angle C1 to the alignment mark 19. To change the combination of the guard plate, one merely has to reposition the fingers or to insert different fingers.

In some embodiments of the device, it may be desirable to eliminate the flange portion of the fingers. In such a case, one portion of the rounded fingers would be essentially flat. When this flat portion was aligned with the grooves 18, rotation of the disc 4 would be possible.

Because of the nature of this device, a high degree of accuracy in positioning the fingers is not necessary in order to permit rotation of the disc 4. Thus, if only a portion of the cutoff portion 23 is within the circular groove, rotation of the disc 4 will cause the corner 24 of the groove 18 to rotate the finger until the entire cutoff portion 23 is aligned with the groove 18. Thus, a high degree of accuracy in placing the alignment marks 19 and 21 is not required.

In the preferred embodiments, a backing plate 25 may be inserted between the rotatable disc 4 and the door 3. This plate would be used to keep the disc 4 securely against the inner surface of the body 1. In addition, an elastic spacer 26 may then be provided between the plate 25 and the outer surface of the door 3. The plate 25 has an opening 28 within which the cylinder 8 is aligned. Obviously, the elastic spacer 26 must also have an opening within which the cylinder 8 may be positioned.

Figure 8:
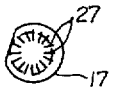
FIG. 8 is a back end view of an alternate embodiment of the fingers.

In order to provide for more accurate positioning of the fingers, teeth 27 may be provided on the back end of the flange 17 (see FIG. 8). A matching set of teeth would then be provided on the plate 25. In the normal position, these teeth would prevent easy rotation of the fingers. During intended rotation of the fingers, inward pressure of the fingers would cause the plate 25 to be moved toward the door, because of the action of the elastic spacer 26, and the fingers would be permitted to rotate to a certain extent. Thus, more accurate alignment of the alignment marks 19 and 21 may be provided.

Figure 9:
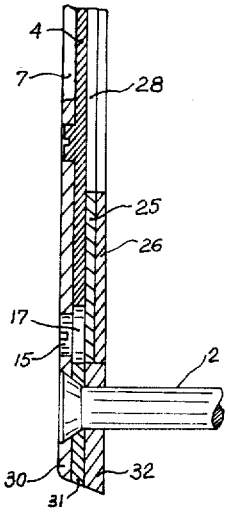
FIG. 9 is a view similar to FIGS. 2 and 7, but showing another embodiment of the body.

In still another embodiment (see FIG. 9), the body 1 may be made of three plates 30, 31 and 32. The outer plate 30 is essentially flat and is provided with a hole 7 to provide access to the cylinder 8. Further, this outer plate 30 has the opening 6 into which the stem 5 of the disc 4 is positioned. The middle plate 31 has a circular recess 34 into which the disc 4 may be positioned. In addition, the middle plate 31 has circular recesses 35 into which the flange portion 17 of the fingers may be positioned. The inner plate 32 is provided with a substantially rectangular recess 36 into which the backing plate 25 may be positioned.

We claim:

1. An improved guard plate for protecting a cylinder of a lock, comprising: a body attached to the door in the vicinity of the cylinder, said body having a first opening in alignment with said cylinder; a disc rotatably mounted on an inside surface of said body between said body and said door, said disc having an opening approximately equal in size to said first opening of said plate; means for rotating said disc positioned on a surface of said disc and being accessible through a second opening in said body; and at least one substantially round finger including a cutoff portion, rounded portions of each finger interacting with a respective groove made on the periphery of said disc to prevent rotation of said disc, rotation of each finger causing said rounded portions to move away from respective grooves and causing said cutoff portions to become aligned with said respective hollow grooves, thereby permitting rotation of said disc, and each finger being rotatably inserted in a respective third opening in said plate.

2. An improved guard plate according to claim 1, wherein each finger includes a rounded stem portion and an enlarged flange portion, said flange portions being essentially round and having a cutoff portion.

3. An improved guard plate according to claim 1, further comprising a stop on the surface of said disc, said stop moving within a circular slot on the inner surface of said body when said disc is rotated.

4. An improved guard plate according to claim 1, further comprising a stop on the inner surface of said body, said stop moving within a circular slot on the surface of said disc when said disc is rotated.

5. An improved guard plate according to either of claims 1 or 2, further comprising an alignment mark on the front surface of each finger, and alignment marks on the surface of said body in the vicinity of each finger.

6. An improved guard plate according to claim 5, wherein there are indicating marks alongside the alignment marks on the surface of said body.

7. An improved guard plate according to claim 5, wherein the cutoff portions of each finger are disposed at different angles.

8. An improved guard plate according to claim 1, further comprising a backing plate disposed between said disc and said door, said backing plate having an opening in alignment with cylinder; and an elastic spacer disposed between said backing plate and said door, said elastic spacer having an opening in alignment with said cylinder.

9. An improved guard plate according to claim 8, wherein said body includes an outer plate in which said first, second and third openings of said body are defined; a middle plate having circular recesses into which said disc and said fingers are disposed; and an inner plate having a recess into which said backing plate is positioned.

10. An improved guard plate according to claim 1, wherein said means for rotating said disc includes a stem extending outward from a surface of said disc and through said second opening of said body.

11. An improved guard plate according to claim 10, wherein said stem includes a slot on a front surface.

12. An improved guard plate according to either of claims 1 or 2, wherein each finger includes a stem portion extending through a respective third opening in said body.

13. An improved guard plate according to claim 12, wherein said stem portion of each finger includes a slot on a front face of said finger.

14. An improved guard plate according to claim 12, wherein each finger includes an enlarged head positioned on a front surface of said stem.

* * * * *